US005304092A

United States Patent [19]

Horiguchi et al.

[11] Patent Number: 5,304,092

[45] Date of Patent: Apr. 19, 1994

[54] COIN FEEDING APPARATUS

[75] Inventors: Nobushige Horiguchi, Kitamoto; Katsuyoshi Miyamoto, Kawaguchi, both of Japan

[73] Assignee: Laurel Bank Machines Co., Ltd., Tokyo, Japan

[21] Appl. No.: 891,041

[22] Filed: Jun. 1, 1992

[30] Foreign Application Priority Data

Jun. 7, 1991 [JP] Japan ..... 3-042798[U]
May 15, 1992 [JP] Japan ..... 4-123877

[51] Int. Cl.[5] ..... G07D 9/04

[52] U.S. Cl. ..... 453/18; 453/57; 198/577

[58] Field of Search ..... 453/16, 17, 18, 31, 453/56, 57, 29, 36, 49; 198/577

[56] References Cited

U.S. PATENT DOCUMENTS 3,861,408 1/1975 Hatanaka et al. ..... 453/57
3,886,957 6/1975 Ushio ..... 453/31
4,137,927 2/1979 Matono ..... 453/61
4,429,781 2/1984 Holzhäuser ..... 198/577 X
4,992,075 2/1991 Miyamoto ..... 453/61

FOREIGN PATENT DOCUMENTS 432675 6/1991 European Pat. Off. ..... 453/31
62-59834 12/1987 Japan .
2-73490 3/1990 Japan ..... 453/56

*Primary Examiner*—Michael S. Huppert
*Assistant Examiner*—Scott L. Lowe
*Attorney, Agent, or Firm*—Keck, Mahin & Cate

[57] ABSTRACT

A coin feeding apparatus for a coin handling machine includes a rotary disk for feeding coins into a coin passage one by one, a coin amount detector for outputting a trigger signal when it detects that the amount of coins has become less than a predetermined amount, a conveyor belt for feeding coins deposited into the coin handling machine onto the rotary disk, a motor adapted for driving the conveyor belt in accordance with the trigger signal from the coin amount detector, and a drive period controller adapted for controlling, in accordance with the denominations of coins to be fed, the drive period during which the motor drives the conveyor belt.

7 Claims, 3 Drawing Sheets

COIN FEEDING APPARATUS

BACKGROUND OF THE INVENTION

The present invention relates to a coin feeding apparatus and, in particular, to a coin feeding apparatus for a coin handling machine, which can prevent coin jamming.

DESCRIPTION OF PRIOR ART

As disclosed in Japanese Patent Publication No. Sho 62-59834, for example, a coin handling machine such as a coin wrapping machine generally comprises a rotary disk for feeding coins to a coin passage one by one, an annular coin guide disposed along the circumference of the rotary disk and having an opening to which coins are led along the inner wall surface of the annular coin guide by the centrifugal force produced by the rotation of the rotary disk, the coin passage connected to the opening of the annular coin guide and adapted for conveying coins toward the inside of the coin handling machine and a double feed preventing means disposed above the coin passage immediately downstream of the opening of the annular coin guide for preventing two coins from being simultaneously fed into the coin passage so that a clearance between the lower face thereof and the upper surface of the coin passage, which is smaller than double the thickness of the thinnest coin to be handled and is greater than the thickness of the thickest coin to be handled, and coins deposited into the coin handling machine are fed onto the rotary disk by a conveyor belt and are fed into the coin passage from the opening of the annular coin guide by the centrifugal force produced by the rotation of the rotary disk.

In the thus constituted coin handling machine, a coin amount detecting means is provided for detecting the amount of coins that have been fed onto the rotary disk. When this coin amount detecting means detects that a predetermined amount of coins have been fed onto the rotary disk, the conveyor belt is stopped and feeding of coins onto the rotary disk is stopped and when the coin amount detecting means detects that the amount of coins has become less than the predetermined amount, the conveyor belt is driven and coins are fed onto the rotary disk.

However, the coin amount detecting means is constituted so as to judge that the predetermined amount of coins have been fed onto the rotary disk when it detects two or more coins stacked up at a specified position on the rotary disk. Therefore, in the case where the conveyor belt is stopped and feeding of coins onto the rotary disk is stopped after the coin amount detecting means detects the predetermined amount of coins, a great amount of coins have already been fed onto the rotary disk upstream of the coin amount detecting means and there is some risk of coin jamming occurring at the double feed preventing means. Therefore, in conventional coin feeding apparatuses, the conveyor belt is driven only for a specified period so that the conveyor belt is stopped before the coin amount detecting means detects the predetermined amount of coins. The specified period is the same irrespective of the denomination of coins.

However, in the case where the conveyor belt is driven for feeding coins onto the rotary disk for the specified period irrespective of the denomination of coins, when coins having a small diameter are fed, the number thereof fed onto the rotary disk becomes considerably greater than that of coins of large diameter and there is still some risk of coins jamming at the double feed preventing means.

SUMMARY OF THE INVENTION

It is, therefore, an object of the present invention to provide a coin feeding apparatus for a coin handling machine, which can reliably prevent coins from jamming on a rotary disk.

The above and other objects of the present invention can be accomplished by a coin feeding apparatus for a coin handling machine comprising a rotary disk for feeding coins into the coin passage one by one and a coin amount detecting means for outputting a trigger signal when it detects that the amount of coins has become less than a predetermined amount, the coin feeding apparatus comprising a conveyor belt means for feeding coins deposited into the coin handling machine onto the rotary disk and a conveyor belt drive means adapted for driving the conveyor belt means in accordance with the trigger signal from the coin amount detecting means, the coin feeding apparatus further comprising a drive period control means adapted for controlling, in accordance with the denominations of the coins to be fed, a drive period during which the conveyor belt drive means drives the conveyor belt means.

In a preferred aspect of the present invention, a memory means is further provided for storing different drive periods associated with the denominations of the coins and the drive period control means is constituted so as to read out from the memory means the drive period for the denomination of the smallest coins among the denominations of coins to be fed and cause the conveyor belt drive means to drive the conveyor belt means for this drive period.

In a further preferred aspect of the present invention, a drive period is stored in the memory means for each denomination of coins and the drive period is set shorter for coins of smaller diameter.

In further preferred aspect of the present invention, the denominations of coins are classified into two or more groups in accordance with the diameters of the coins and a drive period is set for each group and stored in the memory means, and the drive period control means is constituted so as to read out from the memory means the drive period for the group to which the denomination of the smallest coins among the denominations of coins to be fed belongs and cause the conveyor belt drive means to drive the conveyor belt means for this drive period.

In a further preferred aspect of the present invention, there is further provided a coin denomination setting means adapted for setting a denomination and the drive period control means is constituted so as to read out a drive period corresponding to the denomination of coins set by the denomination setting means and cause the conveyor belt drive means to drive the conveyor belt means for this drive period.

The above and other objects and features of the present invention will become apparent from the following description made with reference to the accompanying drawings.

DESCRIPTION OF THE PREFERRED EMBODIMENT

Figure 1:
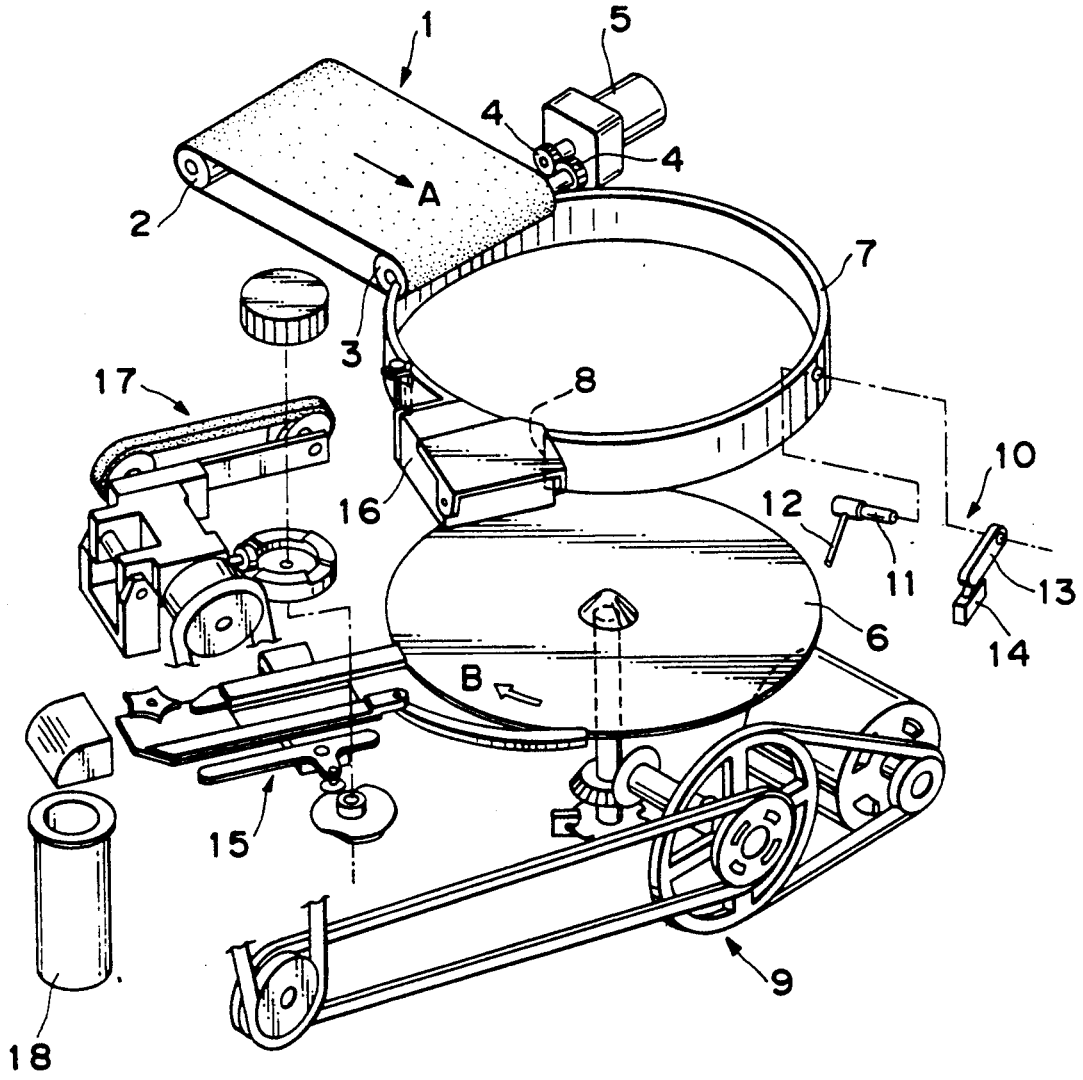
FIG. 1 is a schematic drawing showing an exploded perspective view of a coin feeding apparatus which is an embodiment of the present invention.

Referring to FIG. 1, below a hopper (not shown) connected to a coin deposit opening (not shown) of a coin handling machine, a conveyor belt 1 consisting of an endless belt is disposed and coins deposited into the coin handling machine are fed onto the conveyor belt 1. The conveyor belt 1 is wound around a pair of pulleys 2, 3 and the pulley 3 is connected to a motor 5 via gears 4, 4, whereby the conveyor belt 1 is driven in the direction indicated by an arrow A by the motor 5 so as to feed coins lying on its upper face onto a rotary disk 6.

An annular coin guide 7 having an opening 8 is disposed along the circumference of the rotary disk 6. The rotary disk 6 is rotatable in the direction indicated by a arrow B by a drive mechanism 9 and coins that have been fed onto the rotary disk 6 are fed along the inner wall surface of the coin guide 7 toward the opening 8 by the centrifugal force produced by the rotation of the rotary disk 6.

A coin amount detecting means 10 is provided on the coin guide 7. The coin amount detecting means 10 comprises a rotatable shaft 11 penetrating the coin guide 7, a detecting lever 12 fixed at one end of the rotatable shaft 11 which projects over the rotary disk 6, a weight lever 13 fixed at the other end of the rotatable shaft 11 and a contact member 14 having a contact. These members are arranged so that the clearance between the lower end of the detecting lever 12 and the upper face of the rotary disk 6 is greater than the thickness of the greatest diameter of coins to be handled and slightly smaller than double the thickness of the smallest diameter of coins to be handled when the weight lever 13 contacts the contact of the contact member 14. Therefore, if two coins lying one upon another pass below the detecting lever 12, the detecting lever 12 is swung upward against the dead load of the detecting lever 12 and the weight lever 13 and the rotatable shaft 11 is rotated clockwise in FIG. 1. As a result, the weight lever 13 is swung upward and moves out of contact with the contact member 14. In this embodiment, the coin amount detecting means 10 is constituted so as to output a trigger signal when the weight member 13 makes contact with the contact of the contact member 14 and to stop outputting the trigger signal when the weight member 13 moves out of contact with the contact of the contact member 14.

A coin passage 15 is connected to the opening 8 of the coin guide 7 and a double feed preventing means 16 is provided above the coin passage 15 immediately downstream of the opening 8. The double feed preventing means 16 is adapted for preventing coins from being fed into the coin passage 15 as lying one upon another. For this purpose, the clearance between the lower face thereof and the upper surface of the coin passage 15 is set to be greater than the thickness of the thickest coins to be handled and slightly smaller than double the thickness of the thinnest coins to be handled.

Coins fed into the coin passage 15 are transported by a transporting belt 17 in the coin passage 15 and after being stacked in a stacking section 18, they are wrapped by a wrapping apparatus (not shown).

Figure 2:
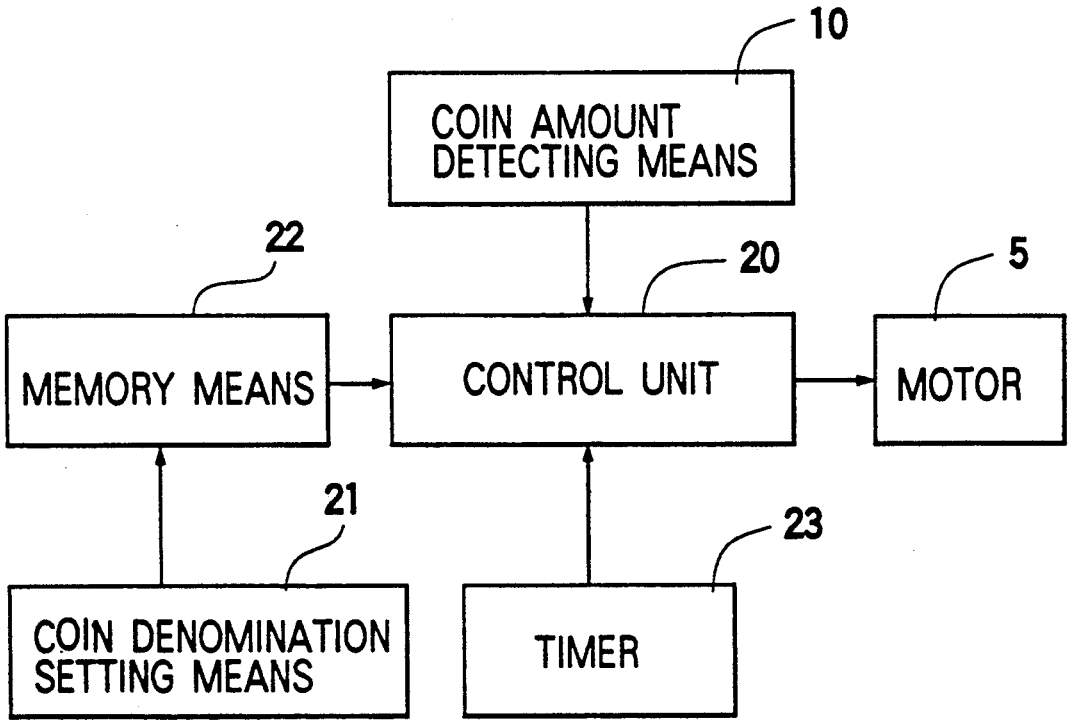
FIG. 2 is a block diagram of a control system and an operation system of a coin feeding apparatus which is an embodiment of the present invention.

FIG. 2 shows a block diagram of a control system and an operation system of a coin feeding apparatus which is an embodiment of the present invention.

Referring to FIG. 2, the control system and the operation system of the coin feeding apparatus comprises a control unit 20 and a coin denomination setting means 21 which is adapted to be operated by an operator and outputs denomination signals to a memory means 22. The memory means 22 is adapted for outputting a drive period corresponding to the denomination specified by the denomination signal output from the coin denomination setting means 21 to the control unit 20. The control unit 20 receives a trigger signal from the coin amount detecting means 10 when the latter detects a predetermined amount of coins. When the control unit 20 receives the trigger signal from the coin amount detecting means 10, it drives the motor 5 for the drive period input from the memory means in accordance with clocking signals from a timer 23, thereby causing the conveyor belt 1 to feed coins onto the rotary disk 6.

The memory means 22 in this embodiment stores one drive period for a larger diameter coin group and another drive period for a smaller diameter coin group and selects one of them in accordance with tho denomination signal from the coin denomination setting means 21 to output it to the control unit 20. More specifically, according to this embodiment, coins are classified into two groups consisting of a larger diameter coin group and a smaller diameter coin group in accordance with denominations and a drive period for each group is calculated and stored in the memory means so that coins of the denomination having the smallest diameter among the coins classified in each group cannot jam at the double feed preventing means 16. For instance, in the case of Japanese coins, the 500 yen coin, 100 yen coin and 10 yen coin are classified into the larger diameter coin group and the 50 yen coin, five yen coin and one yen coin are classified into the smaller diameter coin group. The drive period for the larger diameter coin group is calculated and stored in the memory means 22 so that the 100 yen coins, which are the smallest among the coins belonging to the larger diameter coin group, cannot jam at the double feed preventing means 16 and the drive period for the smaller diameter coin group is calculated and stored in the memory means 22 so that the one yen coins, which are the smallest among the coins belonging to the smaller diameter coin group, cannot jam at the double feed preventing means 16. Thus, the drive period for the smaller diameter coin group is set to a smaller value than that for the larger diameter coin group. For example, the drive period for the smaller diameter coin group is set to 100 milliseconds and the drive period for the larger diameter coin group is set to 170 milliseconds.

The operator judges what denomination of coins is smallest among the coins to be fed and inputs the denomination of the smallest coins into the denomination setting means 21. The denomination setting means 21 then outputs a denomination signal to the memory means 22. The memory means 22 judges based upon this denomination signal to which group the denomination of the smallest coins to be fed belongs and selects the corresponding drive period for output to the control unit 20.

Figure 3:
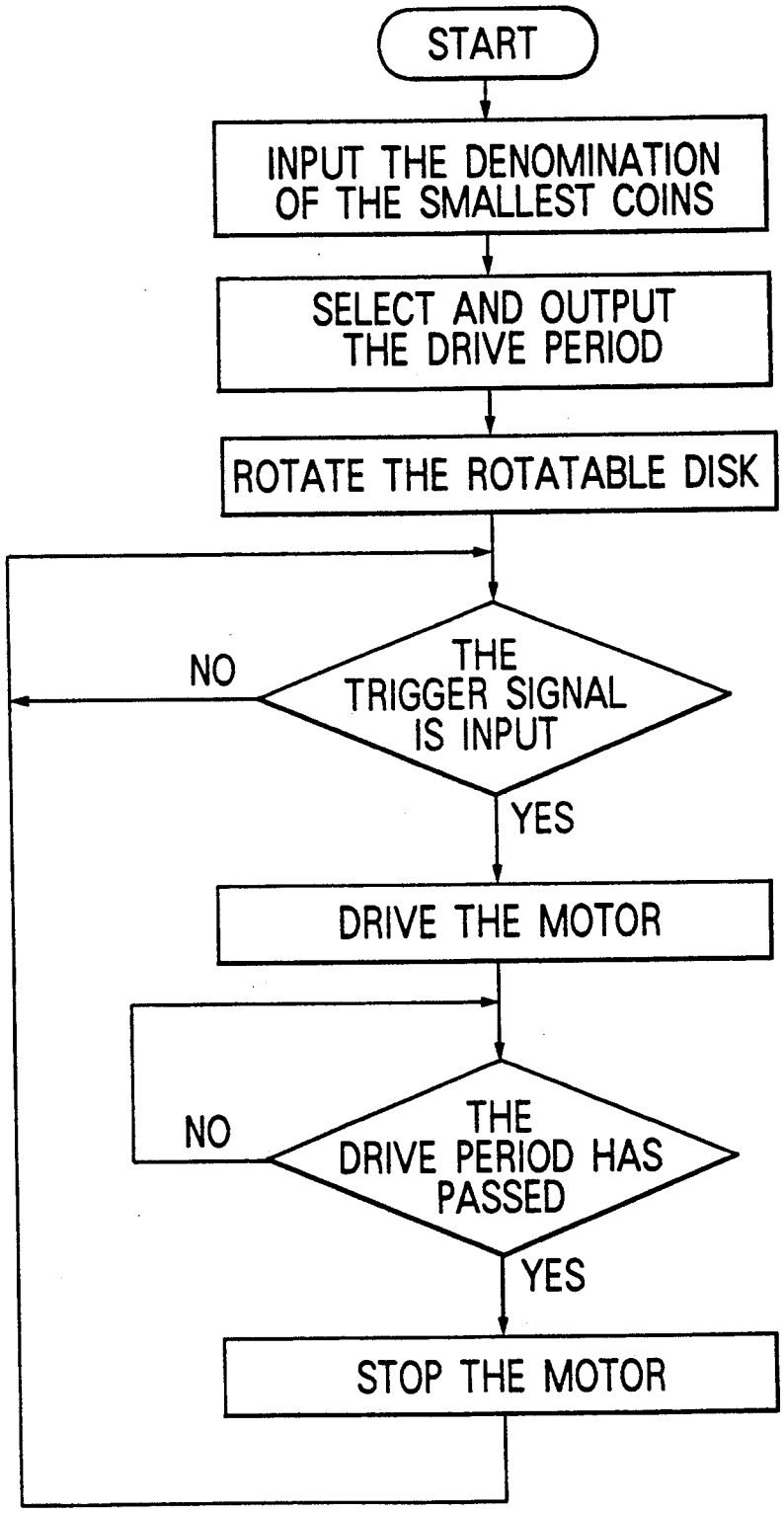
FIG. 3 is a flow chart showing the operation of a coin feeding apparatus which is an embodiment of the present invention.

FIG. 3 is a flow chart showing the operation of the thus constituted coin feeding apparatus.

Referring to FIG. 3, at first, the operator operates the denomination setting means 21 so as to input the denomination of the smallest coins to be fed and a denomination signal is output to the memory means 22.

The memory means 22 judges in accordance with the denomination signal input from the coin denomination setting means 21 whether the denomination of the smallest coins to be fed belongs to the larger diameter coin group or the smaller diameter coin group and selects the corresponding drive period for output to the control unit 20.

Then, the start button (not shown) is operated and the rotary disk 6 is rotated by the drive mechanism 9.

When the trigger signal is input from the coin amount detecting means 10 to the control unit 20, the control unit 20 drives the motor 5 for the drive period input from the memory means 22, thereby driving the conveyor belt 1 and feeding coins onto the rotary disk 6.

When the drive period input from the memory means 22 has passed, the control unit 20 stops the motor 5 until the trigger signal is input again from the coin amount preventing means 10.

According to this embodiment, since a drive period which is set so that the denomination of the smallest coins to be fed cannot jam is selected in accordance with the denomination of the smallest coins to be fed and coins are fed onto the rotary disk 6, it is possible to prevent coins from jamming at the double feed preventing means 16.

According to the present invention, it is possible to provide a coin feeding apparatus for a coin handling machine, which can reliably prevent coins from jamming on a rotary disk of the machine.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although the coin denomination setting means 21 is constituted so that the operator inputs the denomination of the smallest coins to be fed, it is possible to constitute the coin denomination setting means 21 so as to automatically judge the denomination of the smallest coins to be fed and output the denomination signal if the operator inputs the denominations of the coins to be deposited into the coin wrapping machine.

Further, in the above described embodiment, although the memory means 22 is constituted so as to store two kinds of drive periods consisting of the drive period for the larger diameter coin group and the drive period for the smaller diameter coin group, selects one of them in accordance with the denomination signal from the coin denomination setting means 21 and outputs it to the control unit 20, it is possible to calculate a drive period for each denomination of coin, store the drive periods in the memory means 22 and output the drive period for the denomination of the smallest coins to be fed to the control unit 20 in accordance with the denomination signal.

Furthermore, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

We claim:

1. A coin feeding apparatus for a coin handling machine comprising;

a rotary disk for feeding coins into a coin passage one by one;

a coin amount detecting means for outputting a trigger signal when an amount of coins less than a predetermined amount is detected as present on the rotary disk;

a conveyor belt means for feeding coins deposited into the coin handling machine onto the rotary disk;

a conveyor belt drive means for driving the conveyor belt means in response to the trigger signal from the coin amount detecting means;

a drive period control means for controlling a drive period during which the conveyor belt drive means drives the conveyor belt means, the drive period control means being capable of controlling different drive periods in accordance with each denomination of coins to be fed;

a memory means for storing the different drive periods which are predetermined for each denomination of coins to be fed; and wherein said different drive periods are generally shorter in duration for coins of smaller diameter as compared to coins of larger diameter.

2. A coin feeding apparatus in accordance with claim 1, further comprising:

means for reading out from the memory means a drive period for the denomination of the smallest coins among the denominations of coins to be fed, and wherein said conveyor belt drive means drives the conveyor belt means for said drive period for the denomination of the smallest coins among the denominations of coins to be fed, in response to said trigger signal.

3. A coin feeding apparatus in accordance with claim 2 wherein said drive periods are unique and are stored in the memory means for each denomination of coins to be fed and the drive period is shorter for coins of smaller diameter than for coins of larger diameter.

4. A coin feeding apparatus in accordance with claim 3 which further includes a coin denomination setting means adapted for setting a denomination of coins to be fed, and wherein said means for reading out from the memory means reads out a drive period corresponding to the denomination of coins set by the denomination setting means and wherein said drive period control means controls the conveyor belt drive means to drive the conveyor belt means for the drive period corresponding to the denomination of coins set by the denomination setting means.

5. A coin feeding apparatus in accordance with claim 2 wherein denominations of coins are classified into two or more groups in accordance with a denomination's diameter size, and a drive period is set for each group and stored in the memory means and wherein said means for reading out from the memory means reads out a drive period for the group to which the denomination of the smallest coins among the denominations of coins to be fed belongs and wherein said drive period control means controls the conveyor belt drive means to drive the conveyor belt means for said drive period for the group to which the denomination of the smallest coins among the denominations of coins to be fed belongs.

6. A coin feeding apparatus in accordance with claim 5 which further includes a coin denomination setting means adapted for setting a denomination of coins to be fed, and wherein said means for reading out from the memory means reads out a drive period corresponding to the denomination of coins set by the denomination setting means and wherein said drive period control means controls the conveyor belt drive means to drive the conveyor belt means for the drive period corresponding to the denomination of coins set by the denomination setting means.

7. A coin feeding apparatus in accordance with claim 2 which further includes a coin denomination setting means adapted for setting a denomination of coins to be fed, and wherein said means for reading out from the memory means reads out a drive period corresponding to the denomination of coins set by the denomination setting means and cause wherein said drive period control means controls the conveyor belt drive means to drive the conveyor belt means for the drive period corresponding to the denomination of coins set by the denomination setting means.

* * * * *

UNITED STATES PATENT AND TRADEMARK OFFICE

CERTIFICATE OF CORRECTION

PATENT NO. : 5,304,092

DATED : April 19, 1994

INVENTOR(S) : Horiguchi, et al.

It is certified that error appears in the above-indentified patent and that said Letters Patent is hereby corrected as shown below:

On the Title Page, at [75], the second inventor's name should read --Katsuyuki Miyamoto--.

Signed and Sealed this

Sixteenth Day of August, 1994

*Attest:*

*Attesting Officer*

BRUCE LEHMAN

*Commissioner of Patents and Trademarks*